US009831018B2

(12) United States Patent
Ikeda et al.

(10) Patent No.: US 9,831,018 B2
(45) Date of Patent: Nov. 28, 2017

(54) ELECTRONIC COMPONENT

(71) Applicant: Murata Manufacturing Co., Ltd., Nagaokakyo-shi, Kyoto-fu (JP)

(72) Inventors: Hiroshi Ikeda, Nagaokakyo (JP); Tadamasa Miura, Nagaokakyo (JP); Kiyohiro Koto, Nagaokakyo (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 44 days.

(21) Appl. No.: 14/937,969

(22) Filed: Nov. 11, 2015

(65) Prior Publication Data

US 2016/0064124 A1 Mar. 3, 2016

Related U.S. Application Data

(63) Continuation of application No. PCT/JP2014/061958, filed on Apr. 30, 2014.

(30) Foreign Application Priority Data

May 13, 2013 (JP) ..... 2013-101212
Apr. 10, 2014 (JP) ..... 2014-080964

(51) Int. Cl.
*H01C 7/00* (2006.01)
*H01C 7/04* (2006.01)
(Continued)

(52) U.S. Cl.
CPC ..... *H01C 7/006* (2013.01); *H01C 7/021* (2013.01); *H01C 7/041* (2013.01); *H01C 7/1013* (2013.01)

(58) Field of Classification Search
CPC ..... H01C 7/006; H01C 7/021; H01C 7/041
(Continued)

(56) References Cited

U.S. PATENT DOCUMENTS 4,786,888 A * 11/1988 Yoneda ..... H01C 7/04 219/505
2009/0085714 A1* 4/2009 Yamashita ..... H01C 1/028 338/22 R (Continued)

FOREIGN PATENT DOCUMENTS

JP 06-61012 A 3/1994
JP 07-99101 A 4/1995

(Continued)

OTHER PUBLICATIONS

Official Communication issued in International Patent Application No. PCT/JP2014/061958, dated Jul. 22, 2014.

*Primary Examiner* — Kyung Lee
*Assistant Examiner* — Iman Malakooti
(74) *Attorney, Agent, or Firm* — Keating & Bennett, LLP

(57) ABSTRACT

An electronic component in which a metal layer is unlikely to be peeled from a substrate includes an insulating ceramic substrate, a ceramic layer diffusion-bonded to the substrate, a metal layer including a first principal surface and a second principal surface opposed to the first principal surface, with the first principal surface diffusion-bonded to the ceramic layer, and a characteristic layer diffusion-bonded to the second principal surface of the metal layer and prepared from a ceramic material, wherein the characteristic layer varies in resistance value with respect to ambient temperature or applied voltage.

16 Claims, 3 Drawing Sheets

(51) Int. Cl.
*H01C 7/02* (2006.01)
*H01C 7/10* (2006.01)

(58) Field of Classification Search
USPC ..... 338/22 R, 14
See application file for complete search history.

(56) References Cited

U.S. PATENT DOCUMENTS

| | | | | |
|---|---|---|---|---|
| 2010/0214054 | A1* | 8/2010 | Kobayashi | G01K 7/22 338/22 R |
| 2012/0252657 | A1* | 10/2012 | Sato | C04B 35/4682 501/139 |

FOREIGN PATENT DOCUMENTS

| | | | | |
|---|---|---|---|---|
| JP | 09-98023 | A | 4/1997 | |
| JP | 2001-030864 | A | 2/2001 | |
| JP | 2005-298259 | A | 10/2005 | |
| JP | 2012-079976 | * | 10/2010 | H01C 7/04 |
| JP | 2012-079976 | A | 4/2012 | |

* cited by examiner

ELECTRONIC COMPONENT

BACKGROUND OF THE INVENTION

1. Field of the Invention

The present invention relates to an electronic component including a substrate and a ceramic characteristic layer provided on the substrate.

2. Description of the Related Art

Conventionally, as this type of electronic component includes, for example, a thick film thermistor described in Japanese Patent Application Laid-Open No. 7-99101. This thick film thermistor is prepared in accordance with the following steps. More specifically, a conductor paste is applied onto one surface of an alumina substrate as an example of an insulating substrate, and is subjected to firing to form a lower electrode on the alumina substrate. Subsequently, a paste for thick film thermistors is applied so as to have a partial overlap with the lower electrode, and subjected to firing to form a thick film thermistor.

In Japanese Patent Application Laid-Open No. 7-99101, the conductor paste is applied onto the fired alumina substrate, and then subjected to firing. However, an experiment using inverters has found that it is difficult to join the lower electrode obtained by firing the conductor paste to the alumina substrate, and the lower electrode is thus easily peeled from the alumina substrate.

SUMMARY OF THE INVENTION

Preferred embodiments of the present invention provide an electronic component in which a metal layer is unlikely to be peeled from a substrate.

According to a preferred embodiment of the present invention, an electronic component includes a substrate including an insulating ceramic material; a ceramic layer including a ceramic material and diffusion-bonded to the substrate; a metal layer including a first principal surface and a second principal surface opposed to the first principal surface, with the first principal surface diffusion-bonded to the ceramic layer; and a characteristic layer diffusion-bonded to the second principal surface of the metal layer and including a ceramic material, wherein the characteristic layer varies in resistance value with respect to an ambient temperature or an applied voltage.

According various preferred embodiments of the present invention, an electronic component is provided in which a metal layer is unlikely to be peeled from a substrate.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

First Preferred Embodiment

An electronic component according to a first preferred embodiment of the present invention will be described below. The electronic component according to the first preferred embodiment of the present invention will be described below with reference to the drawings. First, the L axis, W axis, and T axis shown in FIGS. 1 and 2 will be defined. The L axis represents a horizontal direction (length direction) of the electronic component, the W axis represents a front-back direction (depth direction) thereof, and the T axis represents a vertical direction (thickness direction) thereof. The same applies to the other figures regarding the definitions of the L axis, W axis, and T axis.

Figure 1:
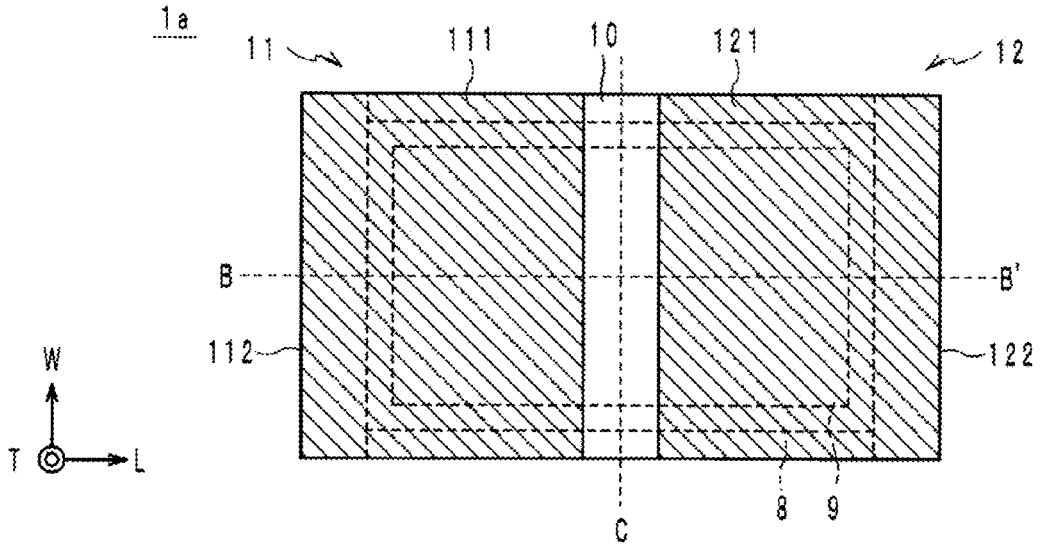
FIG. 1 is a plan view illustrating a completed product of an electronic component according to a first preferred embodiment of the present invention.
Figure 2:
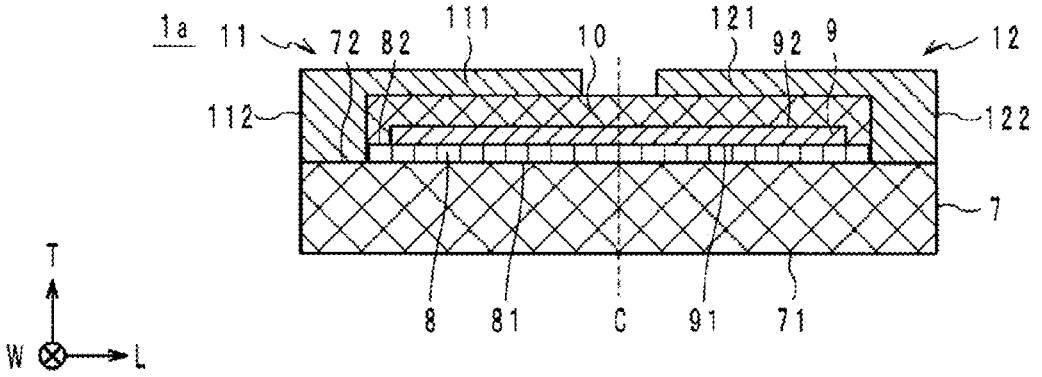
FIG. 2 is a vertical cross-sectional view of a cross section of the electronic component along the line B-B' in FIG. 1 as viewed from the negative in a W axis direction.

As shown in FIGS. 1 and 2, the electronic component 1*a* includes a substrate 7, a ceramic layer 8, an internal electrode 9, a thermistor characteristic layer 10, a first external electrode 11, and a second external electrode 12.

The substrate 7 is preferably made of an insulating ceramic containing, for example, alumina or aluminum nitride as a basic constituent. The substrate 7 includes a first principal surface 71 and a second principal surface 72 mutually opposed in the vertical direction, and preferably has, for example, a rectangular or substantially rectangular shape as viewed from above. In the present preferred embodiment, the second principal surface 72 is located in the positive area in the T axis direction with the first principal surface 71 as a reference. In addition, the thickness of the substrate 7 preferably is, for example, about 0.635 mm.

The ceramic layer 8 preferably is prepared from the same material as the thermistor characteristic layer 10 described below, and is a thin film that preferably has a rectangular or substantially rectangular shape as viewed from above, and includes a first principal surface 81 and a second principal surface 82 mutually opposed in the vertical direction. In the present preferred embodiment, the second principal surface 82 is located in the positive area in the T axis direction with respect to the first principal surface 81. This ceramic layer 8 is provided on the principal surface 72 of the substrate 7 so as to be surrounded by an outer edge of the substrate 7 as viewed from above. In this regard, the ceramic layer 8 is diffusion-bonded to the principal surface 72 of the substrate 7. The ceramic layer 8 preferably has a thickness of about 5 μm, for example, in order to reduce the size of the electronic component 1*a*.

The internal electrode 9 is an example of a metal layer, and preferably prepared from a single noble metal or an alloy of multiple noble metals. In the present preferred embodiment, the internal electrode is prepared from a metal paste containing silver and palladium. In addition, the internal electrode 9 is a thin film that preferably has a rectangular or substantially rectangular shape as viewed from above, and includes a first principal surface 91 and a second principal surface 92 mutually opposed in the vertical direction. In the present preferred embodiment, the second principal surface 92 is located in the positive area in the T axis direction with the first principal surface 91 as a reference. The internal electrode 9 is provided on the ceramic layer 8 so as to be surrounded by an outer edge of the ceramic layer 8 as viewed from above, and diffusion-bonded to the principal surface 82 of the ceramic layer 8. The internal electrode 9 preferably has a thickness of about 3 μm, for example, in order to reduce the size of the electronic component 1*a*.

The thermistor characteristic layer 10 preferably is a thermistor with a negative temperature coefficient (that is, an NTC thermistor), which is prepared in such a way that oxides of nickel, manganese, cobalt, iron and the like are mixed and subjected to sintering. This thermistor characteristic layer 10 is a thin film that preferably has a rectangular or substantially rectangular shape as viewed from above, and is provided on the metal layer 9 so that the outline of the thermistor characteristic layer itself has a substantial overlap with the outline of the ceramic layer 8 as viewed from above. In this regard, the thermistor characteristic layer 10 is diffusion-bonded to the principal surface 92 of the internal electrode 9. The thermistor characteristic layer 10 preferably has a thickness of about 10 μm, for example, in order to reduce the size of the electronic component 1*a*.

In this regard, it is to be noted that the thermistor characteristic layer 10, which is preferably formed by screen printing or the like, may be bonded to the ceramic layer 8 but not to be bonded to the substrate 7 as shown in FIG. 2. The reason is as follows. If the thermistor characteristic layer 10 is subjected to firing in abutment with the substrate 7, and then melted and mixed with each other, the phenomenon (diffusion) of atomic substitution between the phases by energy of molecular motion is likely to be caused, because both of the layers are of oxides and also similar in crystal structure. In this case, there is ingress of, for example, Al atoms, from the substrate 7 into the thermistor characteristic layer 10. The reason is because the Al atoms have the possibility of changing characteristics of the resistance value with respect to the ambient temperature of the thermistor characteristic layer 10.

The external electrodes 11, 12 preferably are prepared from the same material as the internal electrode 9 described above. The external electrodes 11, 12 which have mutually symmetrical shapes with respect to a vertical center plane C, are located at an interval in the horizontal direction. In this regard, the vertical center plane C is a plane including the center of the electronic component 1*a* in the L axis direction, and parallel or substantially parallel to a plane WT.

The external electrode 11 preferably includes a thin film 111 and a side wall 112. The thin film 111 has, for example, a rectangular or substantially rectangular shape as viewed from above, and covers the left-hand upper surface of the thermistor characteristic layer 10. In addition, the thin film 111 is opposed to the left-hand portion of the internal electrode 9 in the T axis direction with the left-hand side of the thermistor characteristic layer 10 interposed therebetween, and overlaps with the left-hand side of the internal electrode 9 as viewed from above. Furthermore, the side wall 112 extends alongside surfaces of the ceramic layer 8 and thermistor characteristic layer 10, so as to connect the thin film 111 to the substrate 7.

The external electrode 12 preferably includes a thin film 121 that is symmetrical to the thin film 111 with respect to the vertical center plane C, and a side wall 122 that is symmetrical to the side wall 112 with respect to the vertical center plane C. Therefore, detailed descriptions of the thin film 121 and side wall 122 will be left out.

The external electrodes 11, 12 are opposed respectively to the left-hand side and right-hand side of the internal electrode 9 in the T axis direction, and include overlaps therewith as viewed from above. The external electrodes 11, 12 define and function as input-output terminals, and an electric current i that has a predetermined value flows between the electrodes through the thermistor characteristic layer 10 and the internal electrode 9 (see FIG. 3).

Figure 3:
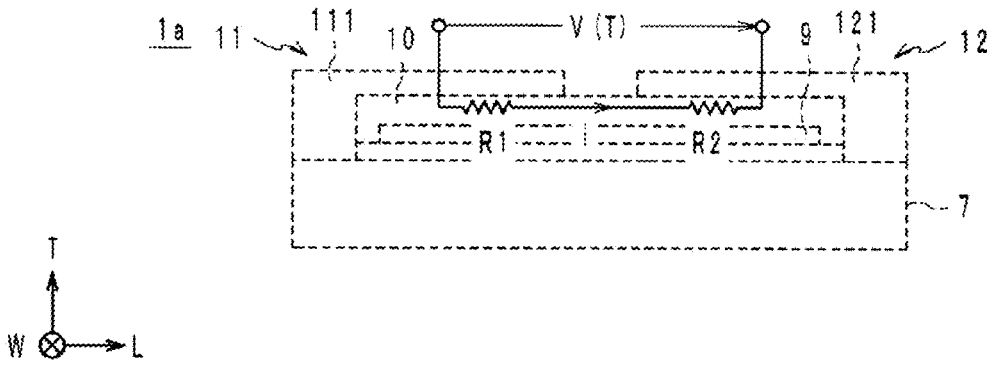
FIG. 3 is a diagram illustrating an equivalent circuit of the electronic component shown in FIG. 2.

In this case, an electric field is provided at a portion of the thermistor characteristic layer 10 between the mutually opposed external electrode 11 and internal electrode 9 and the portion of the thermistor characteristic layer 10 between the external electrode 12 and internal electrode 9, and these portions are responsible for characteristics as an NTC thermistor. More specifically, the portion of the thermistor characteristic layer 10 sandwiched between the external electrode 11 and the internal electrode 9 and the portion thereof sandwiched between the external electrode 12 and the internal electrode 9 provide resistances R1, R2 which have temperature characteristics. Therefore, for example, measuring the voltage V between the input-output terminals makes it possible to measure an ambient temperature T of the electronic component 1*a*. FIG. 3 shows the equivalent circuit by a solid line, and shows the electric current i flowing through the current-carrying path and the voltage V between the input-output terminals by arrows.

The electronic component 1*a* described above may be manufactured according to the following non-limiting example. It is to be noted that a process for manufacturing one electronic component 1 will be also described below for the convenience of explanation.

First, the fired substrate 7 is prepared. This substrate 7 is prepared by a doctor blade method or a roll compaction method, and fired at a temperature of, for example, approximately 1700° C. to approximately 1800° C. The reason that the fired substrate 7 is prepared is because the characteristics of the thermistor characteristic layer 10 are not obtained when the thermistor characteristic layer 10 is subjected to firing at the firing temperature for the substrate 7, due to the fact that the firing temperature for the substrate 7 differs substantially from the firing temperature for the thermistor characteristic layer 10.

Next, a powder is prepared which includes appropriate amounts of metal oxides arbitrarily selected from the group of metal oxides such as $Mn_3O_4$, NiO, $Fe_2O_3$, $TiO_2$, $Co_3O_4$, $Al_2O_3$, and ZnO which can be starting raw materials (that is, elementary raw materials) for the thermistor characteristic layer 10. In this description, predetermined amounts of $Mn_3O_4$, NiO, $Fe_2O_3$, and $TiO_2$ are weighed, and then blended as a specific example.

The weighed powder obtained in the above step is put in a ball mill containing therein a grinding medium such as zirconia, sufficiently subjected wet grinding, and then subjected to calcination at approximately 780° C. for two hours. Thus, a ceramic powder is prepared.

The ceramic powder obtained in the above step is put in a ball mill containing therein a grinding medium such as zirconia, and subjected wet grinding. Thereafter, an organic binder is added to the ceramic powder subjected to wet grinding. Thus, a ceramic paste for screen printing is obtained.

The ceramic paste is first applied by screen printing onto the principal surface 72 of the substrate 7, in order to define the ceramic layer 8 of about 5 μm in thickness after the paste is subjected to firing.

Next, a metal paste containing silver and palladium is applied by screen printing onto the ceramic paste, in order to define the internal electrode 9 of about 3 μm in thickness after the paste is subjected to firing.

Further, the ceramic paste is applied by screen printing onto the metal paste to define the principal surface 92 of the internal electrode 9, in order to define the thermistor characteristic layer 10 of about 10 μm in thickness after the paste is subjected to firing.

Next, the metal paste is applied by screen printing onto the ceramic paste to define the thermistor characteristic layer 10 and the substrate 7, in order to define the external electrodes 11, 12 of about 3 μm in thickness on the thermistor characteristic layer 10 after the paste is subjected to firing.

The laminated body obtained in the way described above is subjected to co-firing at, for example, approximately 1100° C. to approximately 1200° C. for two hours. During the co-firing, the ceramic layer 8 is bonded by diffusion of Al atoms from the substrate 7, and the ceramic layer 8 and the thermistor characteristic layer 10 are bonded to the internal electrode 9 by diffusion of silver atoms or the like from the internal electrode 9. Likewise, the thermistor layer 10 is further bonded to the external electrodes 11, 12 by diffusion of silver atoms or the like from the external electrodes 11, 12. Thus, the electronic component 1*a* is completed as shown in FIG. 1, etc.

The electronic component described in Japanese Patent Application Laid-Open No. 7-99101 has a problem that the lower electrode is easily peeled from the alumina substrate. This is believed to be because the metal and the alumina substrate differ in crystal structure from each other and differ in melt temperature from each other, and it is thus difficult for the metal and the alumina substrate to be diffusion-bonded.

In contrast, the ceramic layer 8 is interposed between the substrate 7 and the internal electrode 9 in the electronic component 1*a* according to a preferred embodiment of the present invention. First, the substrate 7 containing alumina or the like as a basic constituent and the ceramic layer 8 are both oxides, and also quite similar in crystal structure. Therefore, even in the case of firing at approximately 1100° C. to approximately 1200° C., these oxides are melted and mixed with each other, and as a result, Al atoms or the like in the substrate 7 diffuse through the boundary between the phases into the ceramic layer 8. Thus, the substrate 7 is diffusion-bonded to the ceramic layer 8.

On the other hand, ceramic and metal differ from each other in crystal structure and melt temperature, and thus, in general, diffusion is less likely to be caused therebetween as compared with a case between ceramics. However, the ceramic layer 8 and the internal electrode 9 are known to achieve sufficient bonding strength, and multilayer chip NTC thermistors, etc. have been already commercialized actually.

As described above, the substrate 7 and the internal electrode 9 are bonded to the ceramic layer 8 with sufficient strength. More specifically, the interposition of the ceramic layer 8 between the substrate 7 and the internal electrode 9 keeps the internal electrode 9 from being peeled from the substrate 7 in the electronic component 1*a*.

Further, it is also conceivable that the internal electrode 9 is prepared from a metal paste with glass added thereto, as an approach to bond the internal electrode 9 to the substrate 7. However, this approach has difficulty with ensuring sufficient conductivity for the internal electrode 9, because the glass is an insulating material. On the other hand, in this regard, due to the fact that the ceramic layer 8 is just interposed, the internal electrode 9 is prepared from a metal paste with no glass added thereto, and sufficient conductivity is thus ensured.

Figure 4:
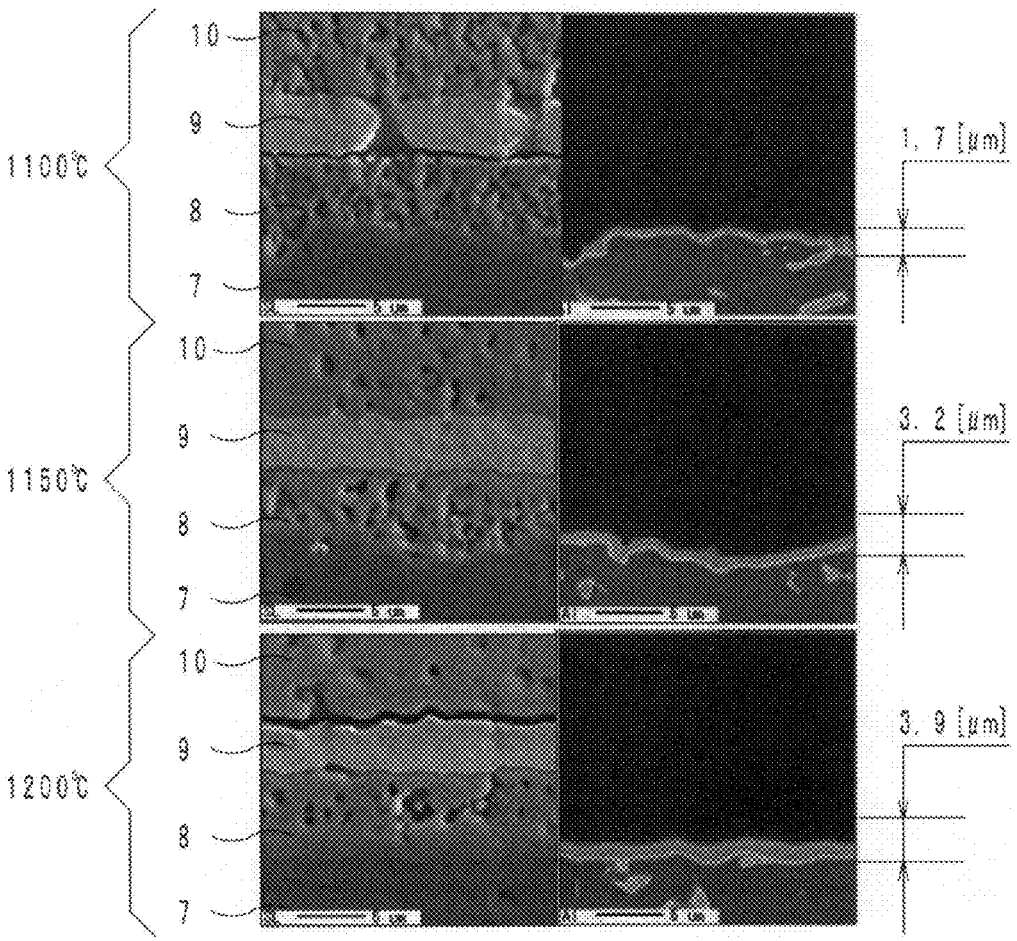
FIG. 4 is a diagram showing diffusion distances of aluminum atoms for firing temperature.

As described above, diffusion causes ingress of Al atoms of the substrate 7 into the ceramic layer 8. In this case, the diffusion distance of the Al atoms is generally correlated with the firing temperature. In this regard, the diffusion distance is the distance of ingress of the Al atoms into the ceramic layer 8 with the principal surface 72 of the substrate 7 as a reference. According to the experiments performed by the inventors, the diffusion distances in the case of firing at 1100° C., 1150° C., and 1200° C. were about 1.7 μm, about 3.2 μm, and about 3.9 μm, as shown in FIG. 4. Therefore, the ceramic layer 8 may have a thickness of about 5 μm as described above. It is to be noted that enlarged views of cross sections from the electronic component 1*a* are shown on the left side of FIG. 4, whereas mapping images for aluminum atoms are shown on the right side of FIG. 4.

From the foregoing, in the present preferred embodiment, the ceramic layer 8 acts as a buffer layer to significantly reduce or prevent interdiffusion that can be caused between the substrate 7 and the thermistor characteristic layer 10, and blocks the atom transfer from the substrate 7 to the thermistor characteristic layer 10. It becomes possible to reduce degraded temperature characteristics of the thermistor characteristic layer 10. As just described, the present preferred embodiment makes it possible to provide the electronic component 1*a* which is able to be reduced in size more than ever before, because it becomes possible to provide the thin-film thermistor characteristic layer 10 on the substrate 7 while the thin-film ceramic layer 8 (buffer layer) eliminates the influence on the characteristics.

Second Preferred Embodiment

Figure 5:
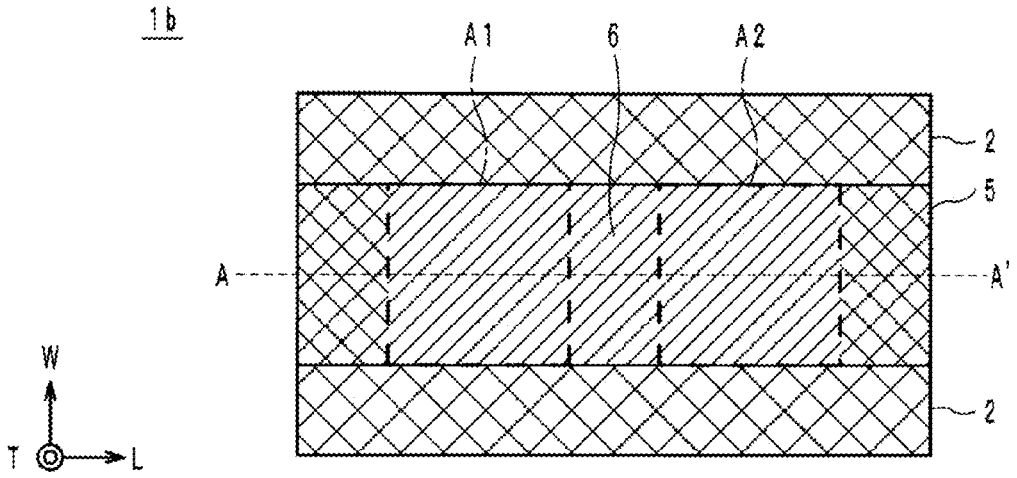
FIG. 5 is a plan view illustrating a completed product of an electronic component according to a second preferred embodiment of the present invention.
Figure 6:
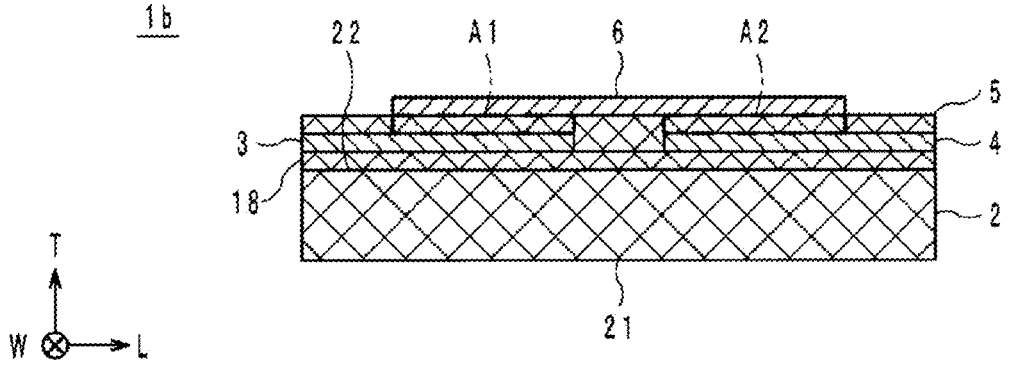
FIG. 6 is a vertical cross-sectional view of a cross section of the electronic component along the line A-A' in FIG. 5 as viewed from the negative on a W axis.

As shown in FIGS. 5 and 6, an electronic component 1*b* preferably includes a substrate 2, a first metal layer 3, a second metal layer 4, a thermistor characteristic layer 5, a third metal layer 6, and a ceramic layer 18.

The substrate 2 is prepared from the similar insulating ceramic to the substrate 7 described above. The substrate 2 includes two principal surfaces 21, 22 mutually opposed in the vertical direction, and preferably has, for example, a rectangular or substantially rectangular shape as viewed from above. In this regard, the principal surface 22 is located in the positive area in the T axis direction with the principal surface 21 as a reference in the present preferred embodiment.

The first metal layer 3 and the second metal layer 4 are typically prepared from a single noble metal or an alloy of multiple noble metals. In the present preferred embodiment, the layers are prepared from a metal paste containing silver and palladium. In addition, the metal layers 3, 4 preferably are, for example, thin films that both have the same or substantially the same rectangular or substantially rectangular shape as viewed from above, and are positioned at an interval in the horizontal direction on the principal surface 22. In this regard, the metal layer 4 is located in the positive area in the L axis direction with the metal layer 3 as a reference in the present preferred embodiment. The metal layers 3, 4 are not to be considered particularly limited in terms of thickness, but preferably have a thickness of about 10 μm.

The thermistor characteristic layer 5 is an NTC thermistor as in the case of the thermistor characteristic layer 10. This thermistor characteristic layer 5 is a thin film that preferably has a rectangular or substantially rectangular shape as viewed from above, and provided on the respective metal layers 3, 4. The thermistor characteristic layer 5 is not to be considered particularly limited on thickness, but preferably have a thickness of about 3 μm, for example.

The third metal layer 6 is a thin film that is prepared from the same metal material as the metal layers 3, 4, and preferably has a rectangular or substantially rectangular shape as viewed from above. This metal layer 6 is opposed to both of the metal layers 3, 4 in the T axis direction, and overlaps therewith as viewed from above. In this regard, in the following description, the region where the metal layers 3, 6 have an overlap with each other as viewed from above is referred to as a first overlap region A1, whereas the region where the metal layers 6, 4 have an overlap with each other is referred to as a second overlap region A2. It is to be noted that these regions A1, A2 refer to regions surrounded by bold dashed lines in each of FIGS. 5 and 6. The metal layer 6 is not to be considered particularly limited on thickness, but preferably have a thickness of about 3 μm, for example.

The ceramic layer 18 is a thin film that is prepared from the same material as the thermistor characteristic layer 5, and has the same or substantially the same rectangular or substantially rectangular shape as the principal surface 22 as viewed from above. In addition, the ceramic layer 18 is interposed between the substrate 2 and the metal layers 3, 4, and the ceramic layer 18 preferably has a thickness of about 5 μm, for example, in order to reduce the size of the electronic component 1*b*.

Figure 7:
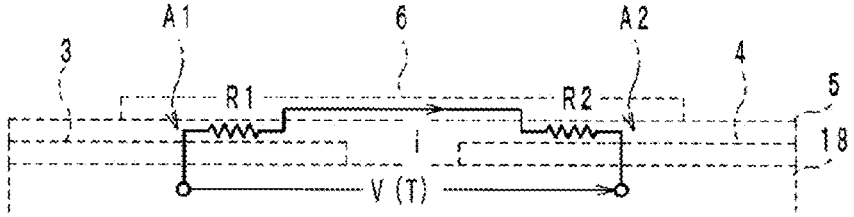
FIG. 7 is a diagram illustrating an equivalent circuit of the electronic component shown in FIG. 5.

As can be seen from the foregoing, the thermistor characteristic layer 5 is sandwiched from above and below between the metal layer 6 and the metal layers 3, 4, and the metal layer is opposed to both of the metal layers 3, 4, in the T axis direction. In addition, the metal layers 3, 4 define and function as an input-output terminal, and an electric current i that has a predetermined value flows between the metal layers 3, through the thermistor characteristic layer 5 and the metal layer 6 (see FIG. 7). In this case, an electric field is generated at a portion between the metal layers 3, 6 opposed to each other, and a portion between the metal layers 6, 4 opposed to each other, and the overlap regions A1, A2 are responsible for characteristics as an NTC thermistor. More specifically, these portions define resistances R1, R2 which have temperature characteristics. Therefore, for example, measuring the voltage V between the input-output terminals (that is, between the metal layers 3, 4) makes it possible to measure an ambient temperature T of the electronic component 1*b*. FIG. 7 shows the equivalent circuit by a solid line, and shows the electric current i flowing through the current-carrying path and the voltage V between the input-output terminals by arrows.

Also in the second preferred embodiment, as in the first preferred embodiment, the interposition of the ceramic layer 18 between the substrate 2 and the metal layers 3, 4 keep the metal layers 3, 4 from being peeled from the substrate 2 in the electronic component 1*b*.

In addition, the thermistor characteristic layers 5, 10 have been described as NTC thermistors in the above preferred embodiments. However, the present invention is not limited thereto, and the thermistor characteristic layers 5, 10 may be PTC thermistors. In addition, in the above preferred embodiments, the electronic components 1*a*, 1*b* may include, in place of the thermistor characteristic layers 5, 10, varistor characteristic layers that vary in resistance value with respect to an applied voltage.

Furthermore, in the above preferred embodiments and modification examples, the thermistor characteristic layers 5, 10 have been described as being formed by screen printing. However, the present invention is not limited thereto, and the characteristic layers 5, 10 may be formed by sputtering, vapor deposition, or an AD method (Aerosol Deposition Method).

Electronic components according to various preferred embodiments of the present invention may be a thermistor or the like, because the metal layer is unlikely to be peeled from the substrate.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An electronic component comprising:

a substrate including an insulating ceramic material;

a ceramic layer diffusion-bonded to the substrate;

a metal layer including a first principal surface and a second principal surface opposed to the first principal surface, with the first principal surface diffusion-bonded to the ceramic layer; and a characteristic layer diffusion-bonded to the second principal surface of the metal layer and including a ceramic material; wherein the characteristic layer varies in resistance value with respect to at least one of an ambient temperature and an applied voltage; and the characteristic layer is bonded to the ceramic layer but is not bonded to the substrate.

2. The electronic component according to claim 1, wherein the ceramic layer blocks atom transfer from the substrate to the characteristic layer.

3. The electronic component according to claim 1, wherein the ceramic layer is made of a same ceramic material as the characteristic layer.

4. The electronic component according to claim 1, wherein the substrate is a multilayer substrate including a plurality of insulating ceramic sheets including silicon-based glass.

5. The electronic component according to claim 1, wherein the substrate is made of an insulating ceramic material containing Al.

6. The electronic component according to claim 1, wherein the characteristic layer is a thermistor characteristic layer.

7. The electronic component according to claim 6, wherein the thermistor characteristic layer has a negative temperature coefficient.

8. The electronic component according to claim 1, further comprising an external electrode connected to the metal layer.

9. The electronic component according to claim 8, wherein the external electrode includes a thin film and a side wall.

10. The electronic component according to claim 1, wherein the ceramic layer defines a buffer layer to reduce or prevent interdiffusion between the substrate and the characteristic layer.

11. The electronic component according to claim 1, wherein the metal layer is a first metal layer, the electronic component further comprising a second metal layer and a third metal layer arranged such that the third metal layer is opposed to the first and second metal layers.

12. The electronic component according to claim 11, wherein the first metal layer, the second metal layer and the third metal layer are made of a same material.

13. The electronic component according to claim 11, wherein the characteristic layer is disposed between the third metal layer and the first and second metal layers.

14. The electronic component according to claim 13, wherein an electric field is generated between the first and third metal layers and between the second and third metal layers to define resistances.

15. The electronic component according to claim 6, wherein the thermistor characteristic layer has a positive temperature coefficient.

16. The electronic component according to claim 1, wherein the characteristic layer is a varistor characteristic layer.

* * * * *